US008002575B2

(12) United States Patent
Li et al.

(10) Patent No.: US 8,002,575 B2
(45) Date of Patent: Aug. 23, 2011

(54) CABLE ASSEMBLY WITH STRAIN RELIEF MEMBER

(75) Inventors: Xiao-Li Li, Kunshan (CN); Ping-Sheng Su, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/829,406

(22) Filed: Jul. 2, 2010

(65) Prior Publication Data

US 2011/0003502 A1 Jan. 6, 2011

(30) Foreign Application Priority Data

Jul. 2, 2009 (CN) ..... 200910303952.X

(51) Int. Cl.
*H01R 13/595* (2006.01)

(52) U.S. Cl. ..... 439/465; 439/99

(58) Field of Classification Search ..... 439/465, 439/99, 460, 467, 98
See application file for complete search history.

(56) References Cited

U.S. PATENT DOCUMENTS

| | | | | |
|---|---|---|---|---|
| 5,383,796 | A | 1/1995 | Bowen et al. | |
| 6,152,746 | A * | 11/2000 | Brown | 439/99 |
| 6,648,690 | B2 * | 11/2003 | Saito et al. | 439/607.44 |
| 6,749,448 | B2 * | 6/2004 | Bright et al. | 439/160 |
| 6,752,663 | B2 * | 6/2004 | Bright et al. | 439/607.25 |
| 7,001,217 | B2 * | 2/2006 | Bright et al. | 439/607.2 |
| 7,044,756 | B1 * | 5/2006 | Asakura et al. | 439/98 |
| 7,090,523 | B2 * | 8/2006 | Shirk et al. | 439/352 |
| 7,815,445 | B2 * | 10/2010 | Wu et al. | 439/99 |
| 2003/0171016 | A1 * | 9/2003 | Bright et al. | 439/160 |
| 2008/0031577 | A1 * | 2/2008 | Walker et al. | 385/92 |

FOREIGN PATENT DOCUMENTS

CN 2891361 4/2007

* cited by examiner

*Primary Examiner* — Gary F. Paumen
(74) *Attorney, Agent, or Firm* — Wei Te Chung; Andrew C. Cheng; Ming Chieh Chang

(57) ABSTRACT

A cable assembly (100) includes a housing having a main portion (11, 21) and a mounting portion (12, 22) extending backwardly from the main portion, the mounting portion defining a positioning cavity (1202, 2202) in an inner side thereof; a cable (4) having a number of wires (41) and a jacket (40), the wires enclosed by the jacket; a strain relief member (7) having an inner ring (71, 72) and an outer ring connected with each other to form a one-piece structure; and the strain relief member mounted to a front segment of the cable, the wires of the cable forwardly extending through the inner ring, the jacket of the cable sandwiched between the outer ring and the inner ring, the outer ring accommodated in the positioning cavity of the mounting portion.

20 Claims, 9 Drawing Sheets

CABLE ASSEMBLY WITH STRAIN RELIEF MEMBER

FIELD OF THE INVENTION

The present invention generally relates to a cable assembly, and more particular to a cable assembly with a strain relief member.

DESCRIPTION OF PRIOR ART

A cable assembly member commonly includes a connector coupled to a cable. A strain relief member is mounted to the cable to prevent it from being damaged. U.S. Pat. No. 5,383,796 discloses an electrical connector which includes a shell having a cavity and a cable-receiving opening adapted to receive an electrical cable. The opening defines an axis, and two screw posts are located in the cavity spaced on opposite sides of the axis such that the cable can be positioned therebetween. A cable clamp member includes a center section adapted to embrace one side of the cable, and a pair of wing sections extending from the center section and having screw-receiving holes aligning with the screw posts. The clamp member includes flanges projecting from the wing sections, with the flanges having slots for embracing ribs on the shell to preposition the cable clamp member over the cable with the screw-receiving holes aligned with the screw posts. However, the cable clamp member may crush cable if the screw posts are tightened excessively. CN Pat. No. 2891361 discloses a cable assembly with a strain relief member. The strain relief member has a U shaped retainer and a ring member which are made of metallic materials. The ring member is mounted onto metallic braiding of the cable assembly and the retainer grips the ring member. The retainer is positioned in an insulative housing of the cable assembly. However, it is difficult to accurately position the ring member and the cable assembly, as the ring member may be deformable when it is crushed.

Hence, an improved cable assembly is highly desired to overcome the aforementioned problems.

SUMMARY OF THE INVENTION

Accordingly, an object of the present invention is to provide a cable assembly with an improved strain relief member.

In order to achieve the object set forth, a cable assembly in accordance with the present invention comprises a housing having a main portion and a mounting portion extending backwardly from the main portion, the mounting portion defining a positioning cavity in an inner side thereof; a cable having a number of wires and a jacket, the wires enclosed by the jacket; a strain relief member having an inner ring and an outer ring connected with each other to form a one-piece structure; and the strain relief member mounted to a front segment of the cable, the wires of the cable forwardly extending through the inner ring, the jacket of the cable sandwiched between the outer ring and the inner ring, the outer ring accommodated in the positioning cavity of the mounting portion.

Other objects, advantages and novel features of the invention will become more apparent from the following detailed description when taken in conjunction with the accompanying drawings.

DETAILED DESCRIPTION OF PREFERRED EMBODIMENTS

Reference will now be made in detail to the preferred embodiment of the present invention.

Figure 1:
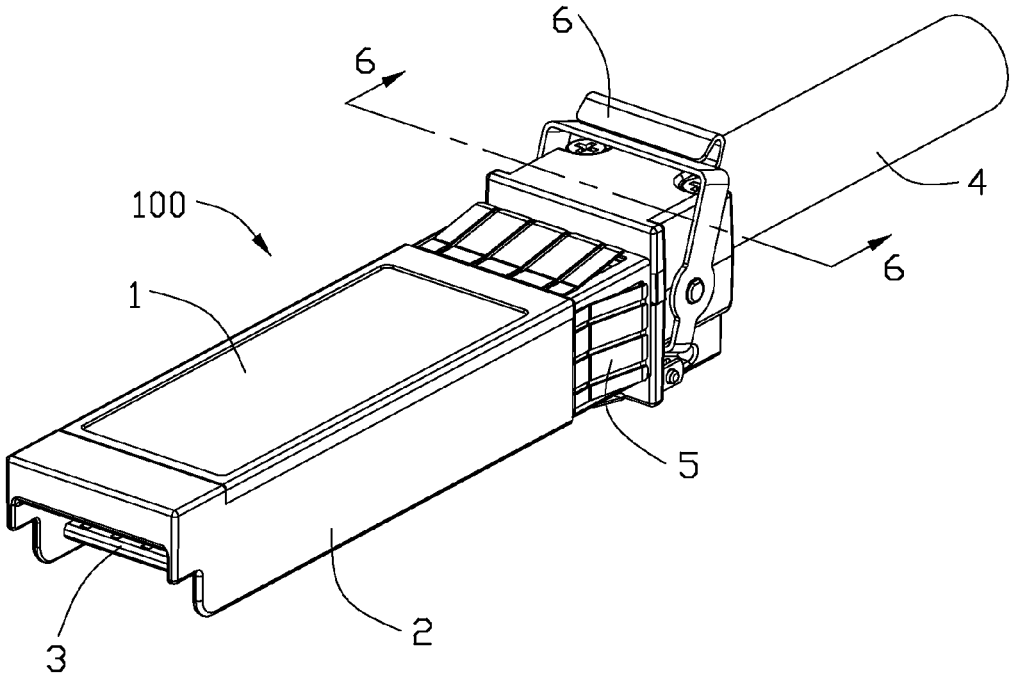
FIG. 1 is an assembled view of a cable assembly of the first embodiment in accordance with the present invention.
Figure 2:
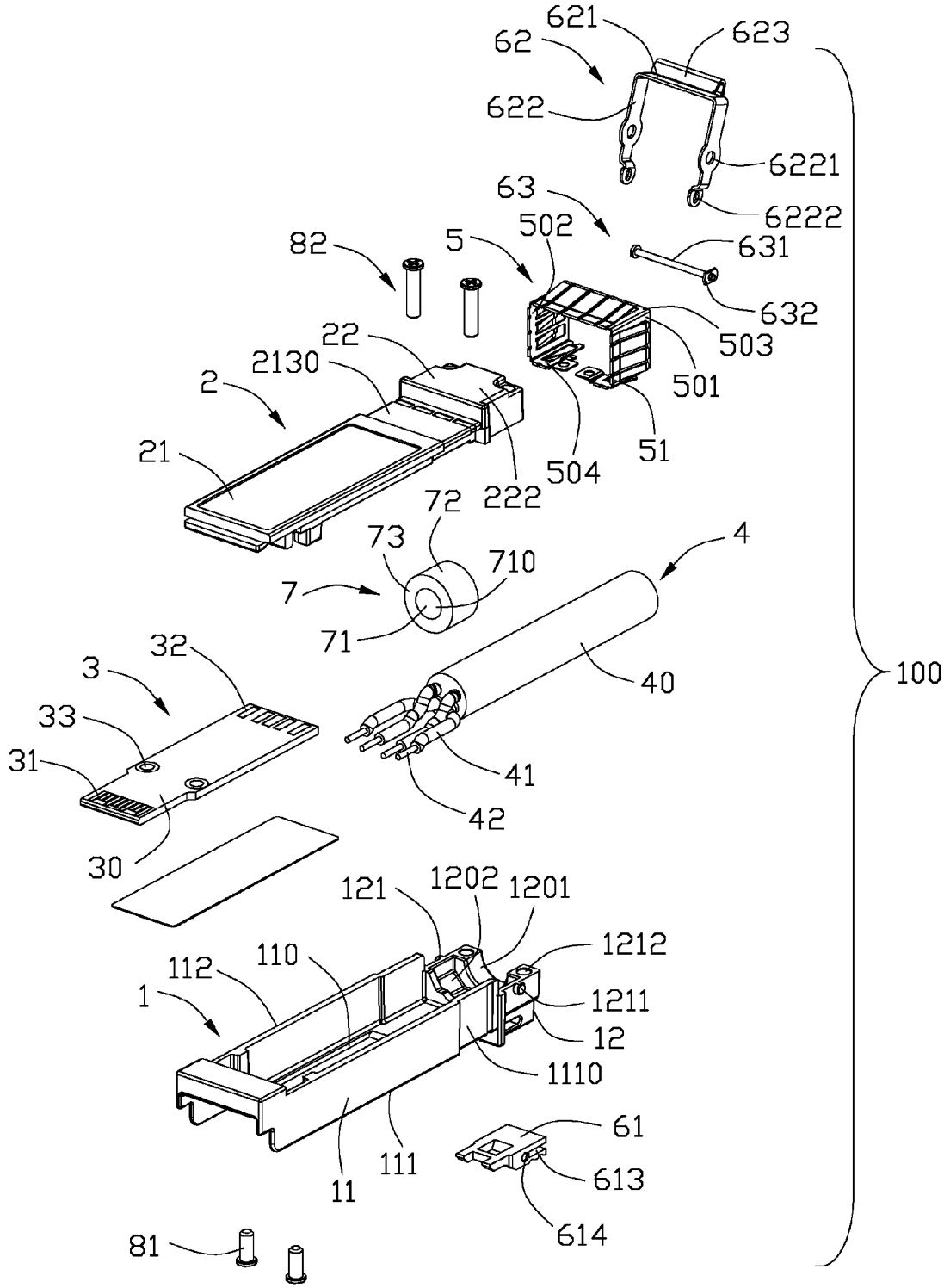
FIG. 2 is an exploded, perspective view of the cable assembly in FIG. 1.
Figure 3:
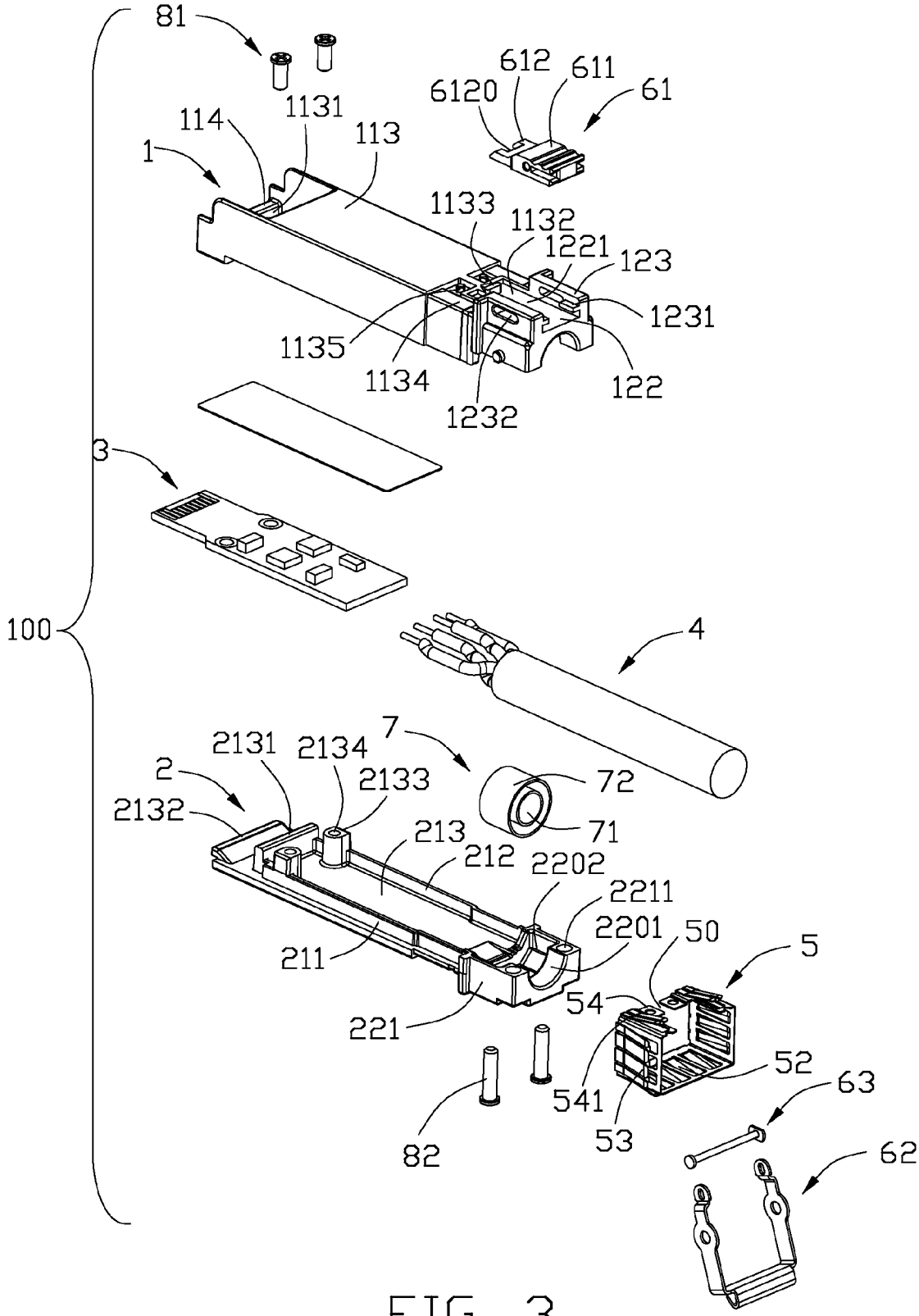
FIG. 3 is similar to FIG. 2, but viewed from another aspect.
Figure 4:
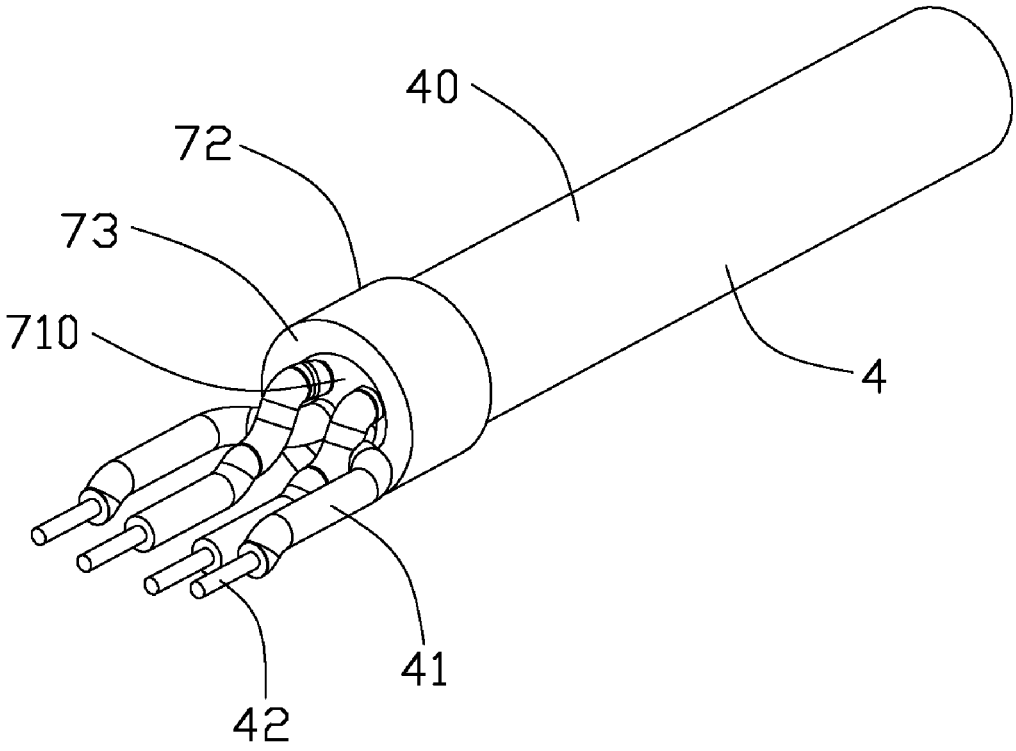
FIG. 4 shows a strain relief member mounted to a cable of the cable assembly.
Figure 5:
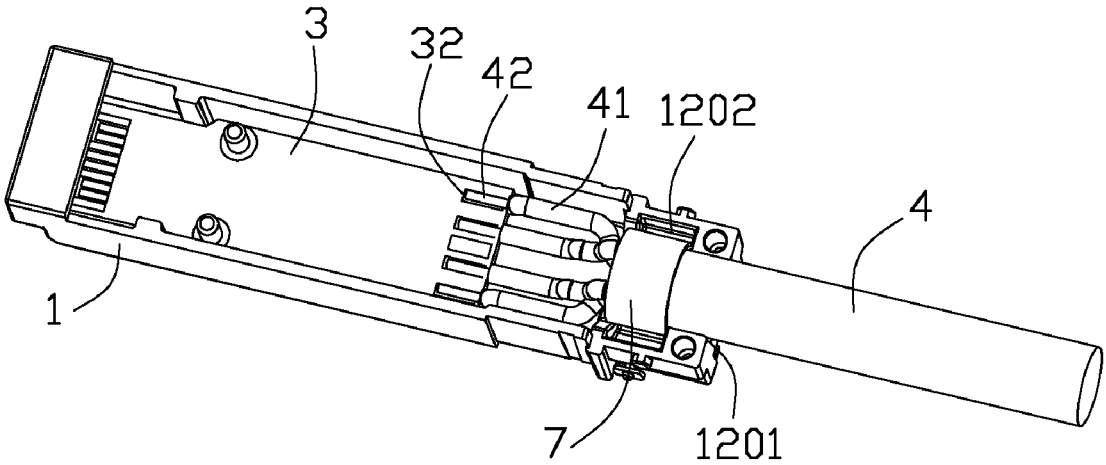
FIG. 5 is partially assembled view of the cable assembly.
Figure 6:
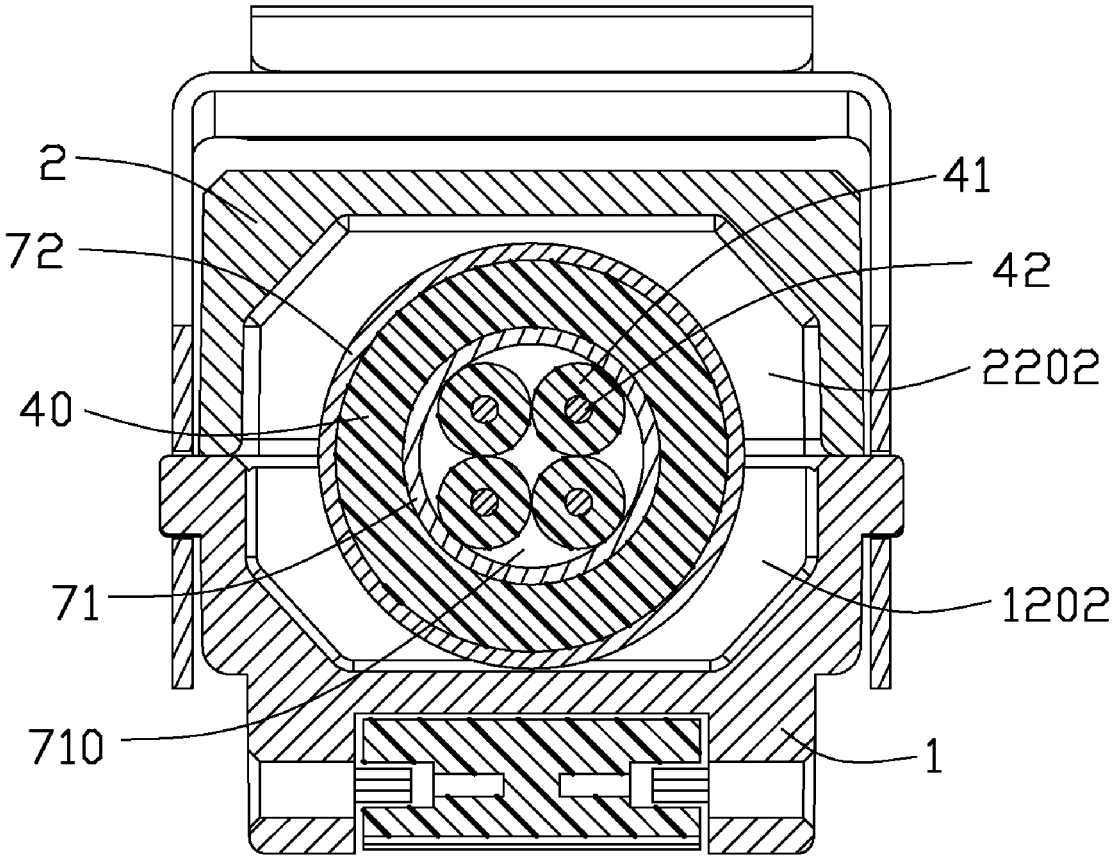
FIG. 6 is cross section view of the cable assembly taken along line 6-6.

Referring to FIGS. 1-3, a cable assembly 100 of the first embodiment in accordance with the present invention comprises a connector and a cable 4 connected to the connector. The connector includes a printed circuit board (PCB) 3 inside an elongated housing which has a cage 1 and a cover 2. The cable assembly 100 further includes a metallic gasket 5, an ejecting mechanism and a strain relief member 7.

Referring to FIGS. 2-3, the cage 1 is a die-cast member and has a first main portion 11 and a first mounting portion 12 extending backwardly from the main portion 11. The first main portion 11 has a pair of side walls 111, 112 and a bottom walls 113 joining with the side walls 111, 112 to define a receiving space 110. Two first depressions 1110 are defined in back segments of peripherals of the side walls 111, 112. A front segment of the bottom wall 113 is cut to form a cutout 1131, and a first channel 1132 is defined in outside of a back segment of the bottom wall 113. A protrusion 1133 is located in the front portion of the first channel 1132. Two L-shaped cavities 1134 are arranged at opposite sides of the first channel 1132. A tiny post 1135 is located in a front corner of the L-shaped cavity 1134. A beam 114 is connected to front ends of the two side walls 111, 112.

The first mounting portion 12 has two lateral walls 121 and a lower wall 122 extending backwardly from the pair of side walls 111, 112 and a bottom walls 113. A semicircular shaped outlet 1201 is arranged between the pair of side walls 121 and the lower wall 122. A positioning cavity 1202 is disposed in front of the outlet 1201. A second channel 1221 is defined in an outside of the lower wall 122 and communicates with the first channel 1132. Two guiding rails 123 are formed on the outside of the lower wall 122 and located at opposite sides of the second channel 1221. A guiding passage 1232 is defined in a front segment of the guiding rail 123 and a guiding tab 1231 is formed on inner side of a back segment of the guiding rail 123. Two poles 1211 are formed on outsides of the lateral walls 121, respectively. Two screw holes 1212 are recessed downwardly from top surfaces of the lateral walls 121.

The cover 2 is a die-cast member and includes a second main portion 21 and a second mounting portion 22 extending backward from the second main portion 21. The second main portion 21 has a planar base 213 and two flanges 211, 212 project downwardly from lateral sides of the base 213. A second depression 2130 is defined in back segment of the base 213. A vertical member 2131 projects downwardly from lower surface of the front segment of the base 213. Two juxtaposed supporting members 2133 are located behind the vertical member 2131, and each supporting member 2133 further defines a screw hole 2134. An engaging member 2132 is attached to a front end of the base 213. The second mounting portion 22 has two lateral walls 221 and a lower wall 222. A semicircular shaped outlet 2201 is arranged between the pair of side walls 221 and the lower wall 222. A positioning cavity 2202 is disposed in front of the outlet 2201. Two through holes 2211 are defined in the lateral walls 221.

The PCB 3 includes a substrate 30, a plurality of first conductive pads 31 formed on a front segment of the substrate 30, a plurality of second conductive pads 32 formed on a rear segment of the substrate 30. Two holes 33 are defined in the substrate 30 and proximate to the front segment thereof.

The cable 4 includes a number of wires 41 enclosed within a jacket 40. Each of the wires 41 has an inner conductor 42.

The metallic gasket 5 is a rectangular shaped frame member 51, and includes two upstanding portions 501, 502 with an upper portion 503 joining with top edges of the two upstanding portions 501, 502, and two lower portions 504 inwardly projecting from bottom edges of the two upstanding portions 501, 502. The two lower portions 504 are separated by a gap 50. A plurality of fingers 52, 53 are attached to the two upstanding portions 501, 502 and the upper portion 503. The fingers 52, 53 are arranged into an outer layer and an inner layer and further overlapped with each other. Two attachment portions 54 are respectively connected to the two lower portions 504 and extend into the gap 50. Each of the attachment portion 54 further defines a hole 541.

The ejecting mechanism 6 includes a slider 61, an actuator 62 and a fastening member 63. The slider 61 has a main portion 611 and two wedged arms 612 projecting forwardly from the main portion 611. A cutout 6120 is formed between the two wedged arms 612. Two slots 613 are defined in back sections of lateral sides of the main portion 611. A transversal hole 614 is defined in middle segment of the main portion 611. The actuator 62 includes a horizontal beam 621 and two legs 622 extending downwardly from opposite ends of the horizontal beam 621. An operating portion 623 protrudes upwardly from back edge of the horizontal beam 621. A first hole 6221 is defined in a middle segment of the leg 622 and a second hole 6222 is defined in a lower segment of the leg 622. The fastening member 63 includes a bolt 631 and a nut 632.

The strain relief member 7 is one-piece structure and lathed by a copper rod or other metallic rod. The strain relief member 7 includes an inner ring 71 and an outer ring 72. The inner ring 71 and the outer ring 72 are coaxially arranged and connected with each other by circular/annular portion 73 to form a one-piece strain relief member 7. The jacket 40 is sandwiched between the inner ring 71 and the outer ring 72, while the wires 41 pass though the inner ring 71.

When assembling, partial of the jacket 40 of the front segment of the cable 4 is stripped off to expose the wires 41 outside. Then the strain relief member 7 is mounted to the front segment of the cable 4, with the wires 41 forwardly extending outside via the inner ring 71 and partial of the jacket 40 inserted into a gap formed between the inner ring 71 and the outer ring 72, and the partial of the jacket 40 abutting against the circular/annular portion 73. The outer ring 72 is crimped to grip the jacket 40, while the inner ring 71 protects wires 41 from being damaged. The wires 41 are soldered to the second conductive pads 32 of the PCB 3. The PCB 3 is supported by the supporting members 2133 of the cover 2 and two screws 81 are inserted into the holes 33 of the PCB and further assembled to the screw holes 2134 of the supporting members 2133. The outer ring 72 of the strain relief member 7 is put into the positioning cavity 2202, and the cable 4 backwardly extends outward via the outlet 2201. The cover 2 is assembled to the cage 1, with the flanges 211, 212 inserted into receiving space 110, the engaging member 2132 engaged with the beam 114 of the cage 1. The PCB 3 is accommodated in the receiving space 110. The strain relief member 7 is received in the positioning cavity 1202. Two screws 82 are inserted into the two through holes 2211 and assembled to the two screw holes 1212. The strain relief member 7 is reliably held by the positioning cavities 1202, 2202.

The gasket 5 is mounted to peripheral of the first main portion 11 and the second main portion 21 and further disposed in front of the strain relief member 7, with the two upstanding portions 501, 502 accommodated in the two first depressions 1110 and the upper portion 503 accommodated in the second depression 2130, the two lower portions 504 accommodated in the L-shaped cavities 1134, and the posts 1135 engage with holes 541 in the attachment portion 54. The slider 61 is mounted to the second channel 1221, with the guiding tabs 1231 respectively inserted into the slots 613, the transversal hole 614 aligned with the guiding passage 1232. The actuator 62 is assembled to the first mounting portion 12, with the first hole 6221 pivotally engaged with the two poles 1211, respectively, and the second hole 6222 aligned with the guiding passage 1232 to let the bolt 631 passing therethrough. The actuator 62 can be rocked to push the slider 61 forwardly move to detach/separate the cable assembly 100 from the complementary connector (not shown).

Figure 7:
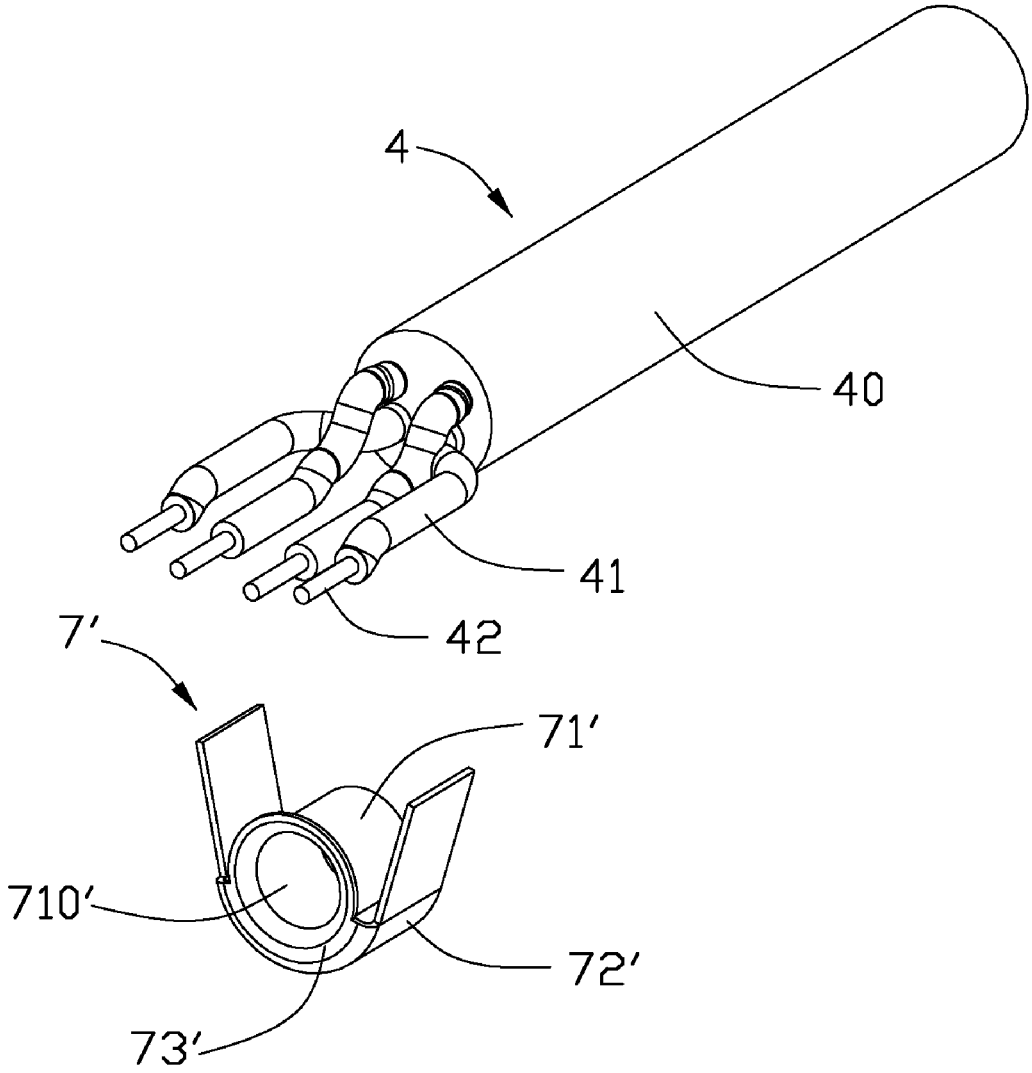
FIG. 7 illustrates a strain relief member and a cable of a cable assembly of the second embodiment in accordance with the present invention.
Figure 8:
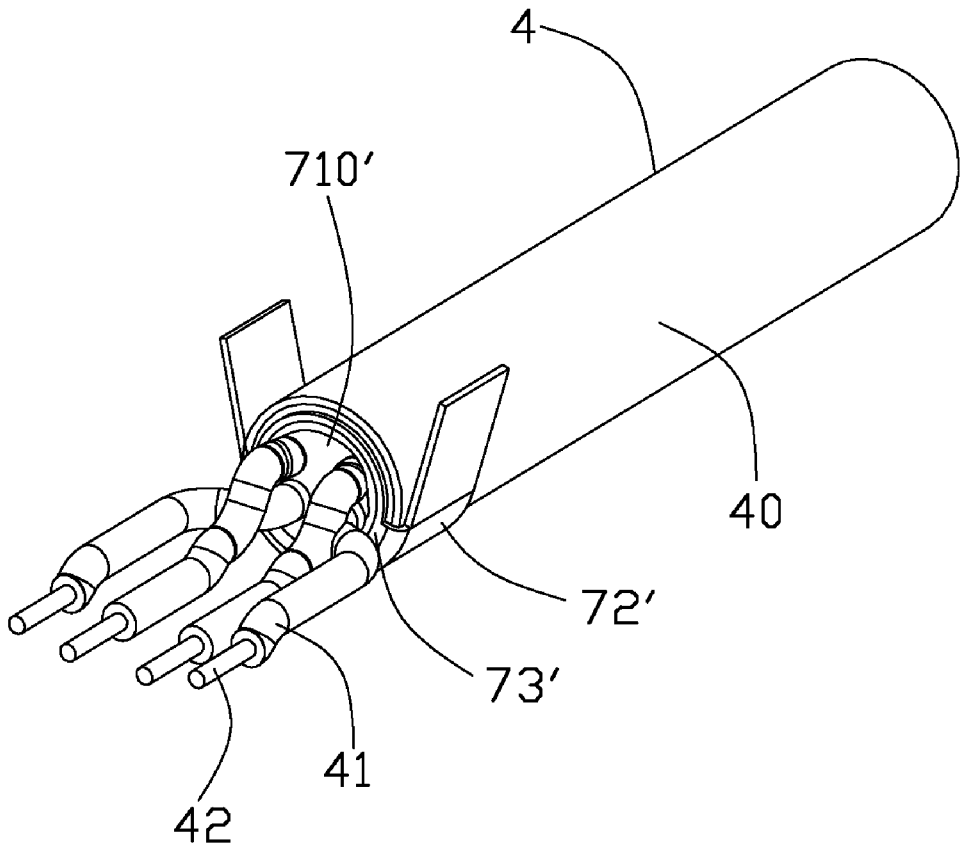
FIG. 8 shows the strain relief member mounted to the cable of the cable assembly.
Figure 9:
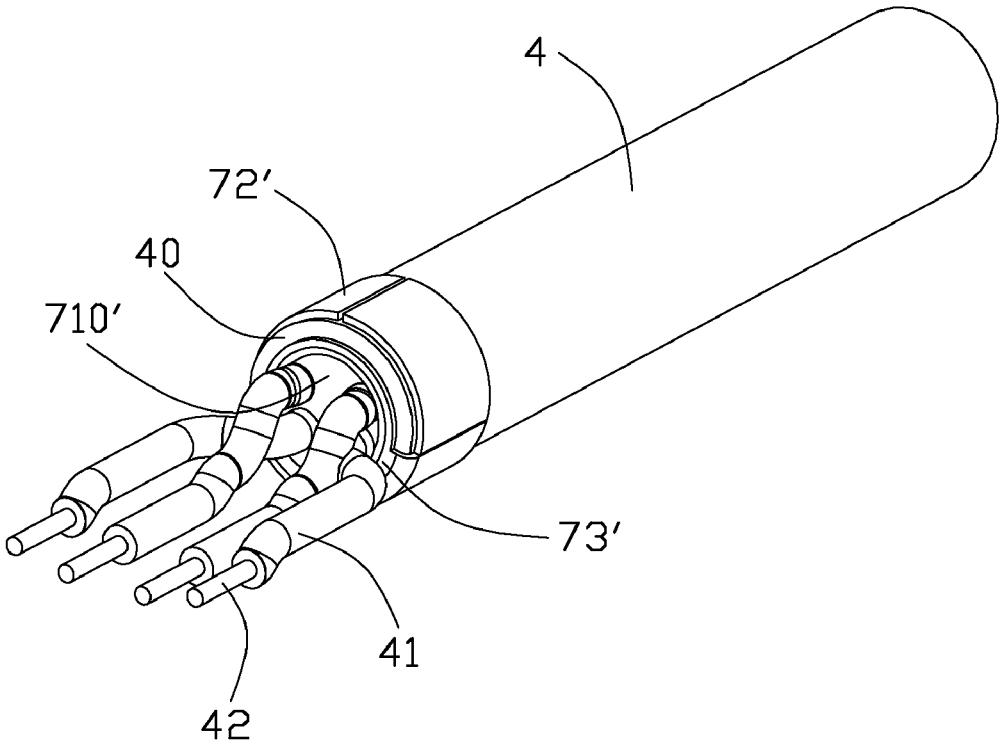
FIG. 9 shows the strain relief member is crimped to the cable.

Referring to FIGS. 7-9 in conjunction with FIGS. 1-8, a strain relief member 7' and a cable 4 of a cable assembly of a second embodiment in accordance with the present invention is introduced. The strain relief member 7' is a one-piece structure and punched by a metallic sheet. The strain relief member 7' includes an inner ring 71' and an outer ring 72' connected with the inner ring 71' by a connection portion 73'. The outer ring 72' is opened along an axial direction to form a U-shaped contour. The strain relief member 7' is mounted to a front portion of the cable 4, with the wires 41 extending through the inner ring 71' and the jacket 40 sandwiched between the inner ring 71' and the outer ring 72' after the outer ring 72' is crimped. Other elements and relations therebetween of the cable assembly of the second embodiment are similar to the cable assembly 100 of the first embodiment, and detailed description is omitted hereby.

In alternated embodiment, the cable 4 further includes a metallic braiding inside the jacket 40 and outside the wires 41. The jacket 40 and the metallic braiding both are sandwiched between the inner ring 41 and the outer ring 42. The outer ring 72 may be polygonal sides, e.g. six sides, eight sides.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A cable assembly, comprising:

a housing having a main portion and a mounting portion extending backwardly from the main portion, the mounting portion defining an outlet;

the mounting portion defining a positioning cavity located in an inner side of the outlet;

a cable having a number of wires and a jacket, the wires enclosed by the jacket;

a strain relief member having an inner ring and an outer ring connected with each other to form a one-piece structure; and the strain relief member mounted to a front segment of the cable, the wires of the cable forwardly extending through the inner ring, the jacket of the cable sandwiched between the outer ring and the inner ring, the outer ring accommodated in the positioning cavity of the mounting portion.

2. The cable assembly as recited in claim 1, wherein the outer ring and the inner ring are coaxially disposed.

3. The cable assembly as recited in claim 2, wherein the strain relief member comprises a circular portion connecting the outer ring with the inner ring.

4. The cable assembly as recited in claim 1, wherein the strain relief member is lathed from a metallic bar to form the outer ring and the inner ring.

5. The cable assembly as recited in claim 1, wherein the strain relief member is punched by a metallic sheet.

6. The cable assembly as recited in claim 5, wherein the inner ring is closed and the outer ring is opened before the strain relief member is crimped to the cable.

7. The cable assembly as recited in claim 1, further comprising a printed circuit board received in the housing.

8. The cable assembly as recited in claim 7, wherein the wires are electrically connected with the printed circuit board.

9. A cable assembly, comprising:

a housing having a cage and a cover assembled together, the cage and the cover together defining a positioning cavity located in inner portions of back segments thereof;

a printed circuit board received in the cage and shielded by the cover;

a cable having a number of wires and a jacket enclosing the wires therein;

a strain relief member having an inner ring and an outer ring integrated together, the outer ring having a slit along an axial direction thereof;

the strain relief member mounted to a front segment of the cable, the wires of the cable forwardly extending through the inner ring and electrically connected with the printed circuit board, the jacket of the cable sandwiched between the outer ring and the inner ring, the outer ring held in the positioning cavity.

10. The cable assembly as recited in claim 9, further comprising an ejecting mechanism mounted to the back segment of the cage.

11. The cable assembly as recited in claim 10, wherein the ejecting mechanism includes a slider, an actuator and a fastening member.

12. The cable assembly as recited in claim 9, further comprising a metallic gasket mounted to the back segments of the cage and the cover.

13. The cable assembly as recited in claim 12, the metallic gasket disposed in front of the strain relief member.

14. The cable assembly as recited in claim 12, wherein the metallic gasket includes a frame structure with a plurality of fingers attached thereto.

15. The cable assembly as recited in claim 9, wherein the printed circuit board is fixed to the cover.

16. A cable connector assembly comprising:

a housing defining a connector holding portion and a cable holding portion;

a connector positioned in the connector holding portion and including a plurality of mating pieces;

a cable positioned in the cable holding portion, and including an outer jacket enclosing a plurality of wires electrically connected to the corresponding mating pieces;

a unitary one-piece strain relief member extending along an axial direction and defining an inner passage through which the wires extend, an middle annual cavity receiving the jacket therein, and an outer contour seated upon the cable holding portion; wherein the cable holding portion defines a positioning cavity to receive said strain relief member and an outlet behind the cavity to allow only the cable to extend therethrough so as to restrain axial movement of the strain relief member relative to the housing; wherein the outer contour is inwardly crimped to grip the jacket while the wires are not damaged within the inner passage.

17. The cable connector assembly as claimed in claim 16, wherein said jacket is equipped with braiding.

18. The cable connector assembly as claimed in claim 16, wherein a front end of the jacket is protectively hidden behind the strain relief member along said axial direction.

19. The cable connector assembly as claimed in claim 16, wherein said outer contour defines a slit to provide radial resiliency thereof.

20. The cable connector assembly as claimed in claim 19, wherein the outer contour is defined by an outer ring, the inner passage is defined by an inner ring under condition that the outer ring and the inner ring are radially linked to each other ring via a connection portion, and wherein portions of the outer ring, which are proximate the slit, are not connected to the connection portion.

* * * * *